US012016448B2

(12) United States Patent
Benezri

(10) Patent No.: US 12,016,448 B2
(45) Date of Patent: Jun. 25, 2024

(54) PORTABLE ACTIVITY TRAY FOR CHILDREN

(71) Applicant: Lulyboo, LLC, Lake Forest, CA (US)

(72) Inventor: Pazit Benezri, Irvine, CA (US)

( * ) Notice: Subject to any disclaimer, the term of this patent is extended or adjusted under 35 U.S.C. 154(b) by 593 days.

(21) Appl. No.: 17/229,796

(22) Filed: Apr. 13, 2021

(65) Prior Publication Data

US 2022/0322814 A1 Oct. 13, 2022

(51) Int. Cl.

| | |
|---|---|
| ***A45F 4/02*** | (2006.01) |
| ***A45F 3/00*** | (2006.01) |
| ***A47B 3/10*** | (2006.01) |
| ***A47B 23/00*** | (2006.01) |

(52) U.S. Cl.

CPC ..... *A45F 4/02* (2013.01); *A45F 3/005* (2013.01); *A47B 3/10* (2013.01); *A47B 23/002* (2013.01); *A45F 2003/003* (2013.01); *A45F 2200/0583* (2013.01)

(58) Field of Classification Search

CPC ..... A45F 4/02; A45F 2200/058; A45F 3/005; A47B 23/002; A47B 3/10

USPC ..... 108/43

See application file for complete search history.

(56) References Cited

U.S. PATENT DOCUMENTS 5,460,102 A * 10/1995 Pasmanick ..... A47B 23/002 108/43
5,467,853 A 11/1995 Pelletier
5,706,992 A * 1/1998 Moor ..... G06F 1/1628 190/102
5,878,672 A * 3/1999 Ostermann ..... B60N 3/004 297/188.06
5,971,148 A * 10/1999 Jackson ..... G06F 1/1628 190/102
5,988,465 A * 11/1999 Vitale ..... A45C 15/00 224/907

(Continued)

FOREIGN PATENT DOCUMENTS

WO 2014054881 A2 4/2014

OTHER PUBLICATIONS www.amazon.com/Portable-Hands-Free-Organizer-Mess-Free-Waterproof/dp/B07KKLWDB8 Cerizona portable kids travel tray multi-pocket car seat tray for toddlers waterproof activity tray pad with hands-free tablet pocket 8 pages Printed Mar. 26, 2021.

(Continued)

*Primary Examiner* — Daniel J Troy
*Assistant Examiner* — Timothy M Ayres
(74) *Attorney, Agent, or Firm* — Rimas T. Lukas

(57) ABSTRACT

A portable activity tray for children is provided. The activity tray includes a first compartment and a second compartment. The first compartment provides a plurality of pockets for storing various items and also provides an activity surface for a child to play, draw and work on. An integrated cup holder is provided. The second compartment includes a removable foam pad making placement of the tray on a child's lap comfortable while simultaneously providing a hard layer for the activity surface that is suitable for writing and drawing. Backpack straps are provided for carrying the tray easily and comfortably while a chest strap serves to stabilize the tray while in use. Playful elements such as a face on outer and inner surface, ears and arm-like flaps with pockets are also provided.

18 Claims, 6 Drawing Sheets

(56) References Cited

U.S. PATENT DOCUMENTS

| | | | | |
|---|---|---|---|---|
| 6,041,715 | A * | 3/2000 | Jarke | A47B 23/002 5/639 |
| 6,116,166 | A | 9/2000 | Rotstein | |
| 6,187,398 | B1 * | 2/2001 | Eldridge | G06F 3/0395 248/118.1 |
| 6,269,948 | B1 * | 8/2001 | Jackson | A45C 7/0095 190/102 |
| 6,381,127 | B1 * | 4/2002 | Maddali | G06F 1/163 D3/276 |
| D485,432 | S * | 1/2004 | Desrochers | D3/217 |
| 8,091,486 | B1 * | 1/2012 | Broaddrick | A47B 23/002 248/444 |
| 9,700,124 | B2 * | 7/2017 | Coleman | A45F 3/04 |
| 10,674,801 | B2 * | 6/2020 | Noguera Ramis | A63H 3/005 |
| D919,961 | S * | 5/2021 | Sprintz | D3/217 |
| 2005/0110309 | A1 | 5/2005 | Cziraky et al. | |
| 2005/0279794 | A1 | 12/2005 | Gerchen | |
| 2011/0013856 | A1 | 1/2011 | Gilbert | |
| 2012/0248163 | A1 | 10/2012 | Biddle | |
| 2013/0153613 | A1 * | 6/2013 | Ciccotosto | A45F 4/02 224/153 |
| 2017/0280867 | A1 | 10/2017 | Peters | |
| 2018/0339660 | A1 * | 11/2018 | Tabor | A45C 13/02 |
| 2019/0142154 | A1 | 5/2019 | Lin | |
| 2021/0274918 | A1 * | 9/2021 | Hanks | A45C 15/00 |
| 2022/0160088 | A1 * | 5/2022 | Malmloff | A45C 9/00 |

OTHER PUBLICATIONS www.cradleplus.com/products/car-seat-travel-tray Kids car seat travel tray 8 pages; Printed Mar. 26, 2021.

* cited by examiner

FIG. 4
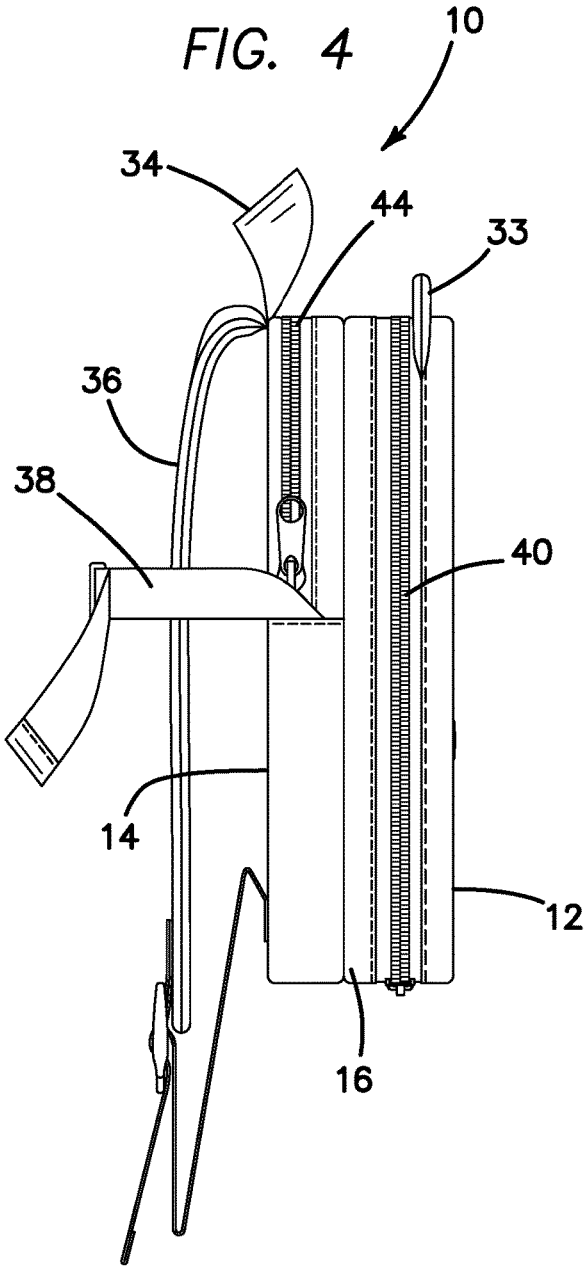
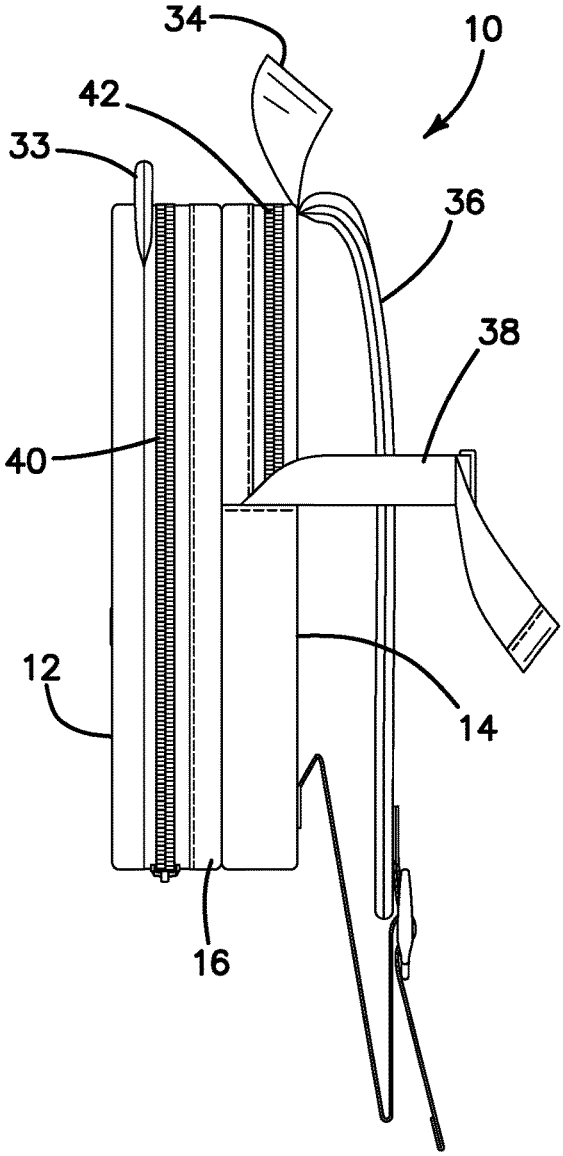
FIG. 5

PORTABLE ACTIVITY TRAY FOR CHILDREN

FIELD OF THE INVENTION

This application relates generally to activity trays, and in particular, to a portable activity tray for children.

BACKGROUND OF THE INVENTION

A child may sit and require a multi-purpose flat surface for a variety of activities. For example, a flat surface may be required to eat a snack, a full meal, set a drink, draw, play with toys, write, read a book, paint or engage in some other activity. A flat surface and accompanying activity objects keep a child interested and engaged in an activity when the child is seated. Especially on trips, a flat surface may not be readily available whether the trip is a longer car ride or plane trip or short walk in the park. Furthermore, before traveling, it is necessary to collect all the possible items that may be needed such as pens, pencils, crayons, markers, paper, toys, books and the like and put them in one place. Many times, an object is forgotten, left behind or lost. It is desirable to have a flat utility surface and all of the activity items conveniently stored in one place and readily accessible and easily taken on the trip and available when it is time to use.

SUMMARY OF THE INVENTION

According to one aspect of the invention, a portable activity tray for children is provided. The activity tray includes a flat front panel having an inner surface and an outer surface, a flat back panel having an inner surface and an outer surface, and a side panel perpendicular to and interconnecting the front panel and the back panel. The activity tray includes an inner panel connected to the side panel along the perimeter of the inner panel. A first compartment is defined between the front panel and the inner panel. The first compartment has a first opening that is closable with a first zipper. The first compartment also has a flat activity surface and a continuous ledge around an entire perimeter of the activity surface. A second compartment is defined between the back panel and the inner panel. The second compartment has a second opening that is closable with a second zipper. The inner panel divides and forms a shared wall between the first compartment and the second compartment.

BRIEF DESCRIPTION OF THE DRAWINGS

FIG. 4 is a right-side plan view of a portable activity tray according to the present invention.

FIG. 5 is a left-side plan view of a portable activity tray according to the present invention.

DETAILED DESCRIPTION OF THE INVENTION

Figure 1:
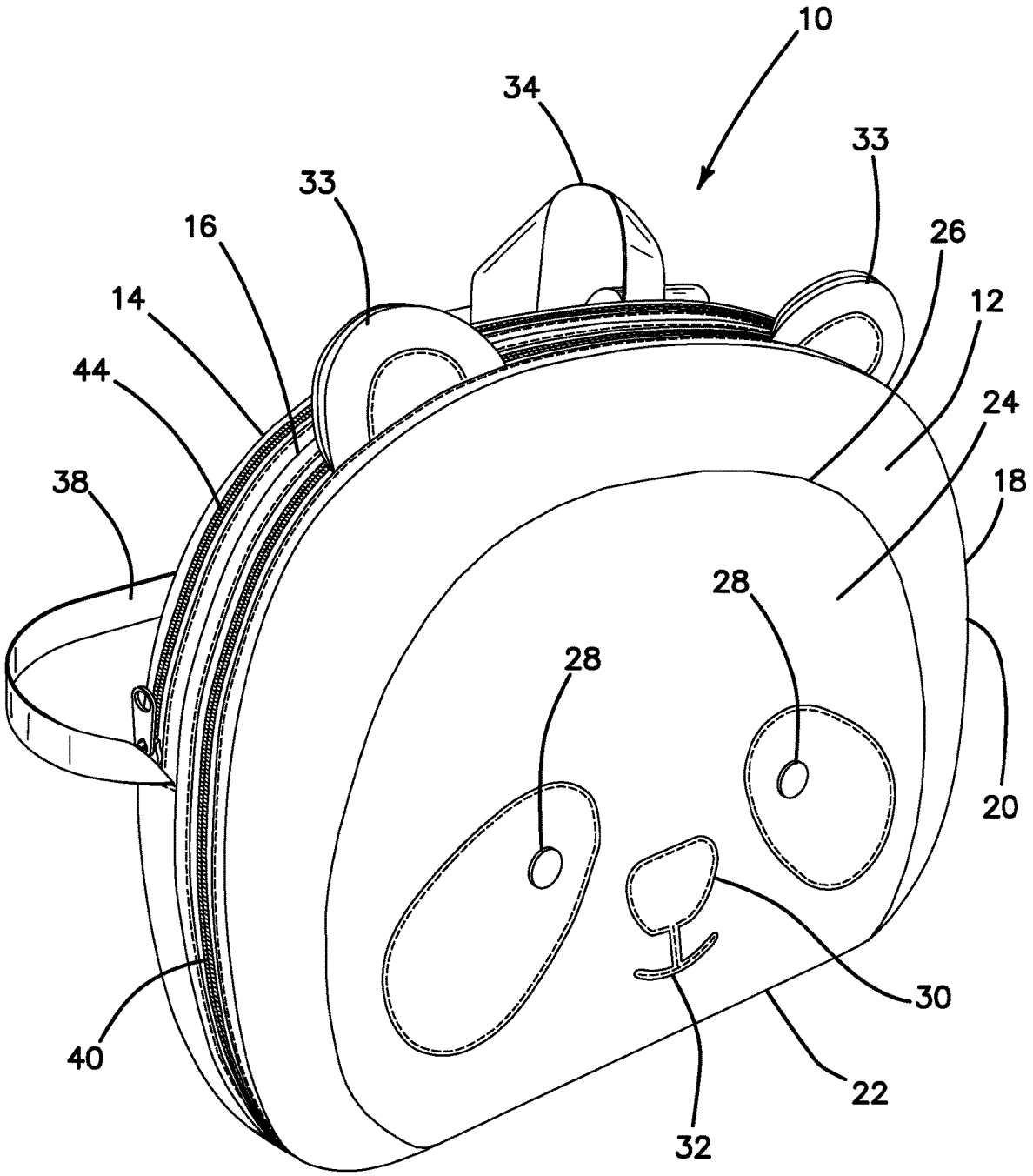
FIG. 1 is a top perspective view of a portable activity tray according to the present invention.
Figure 2:
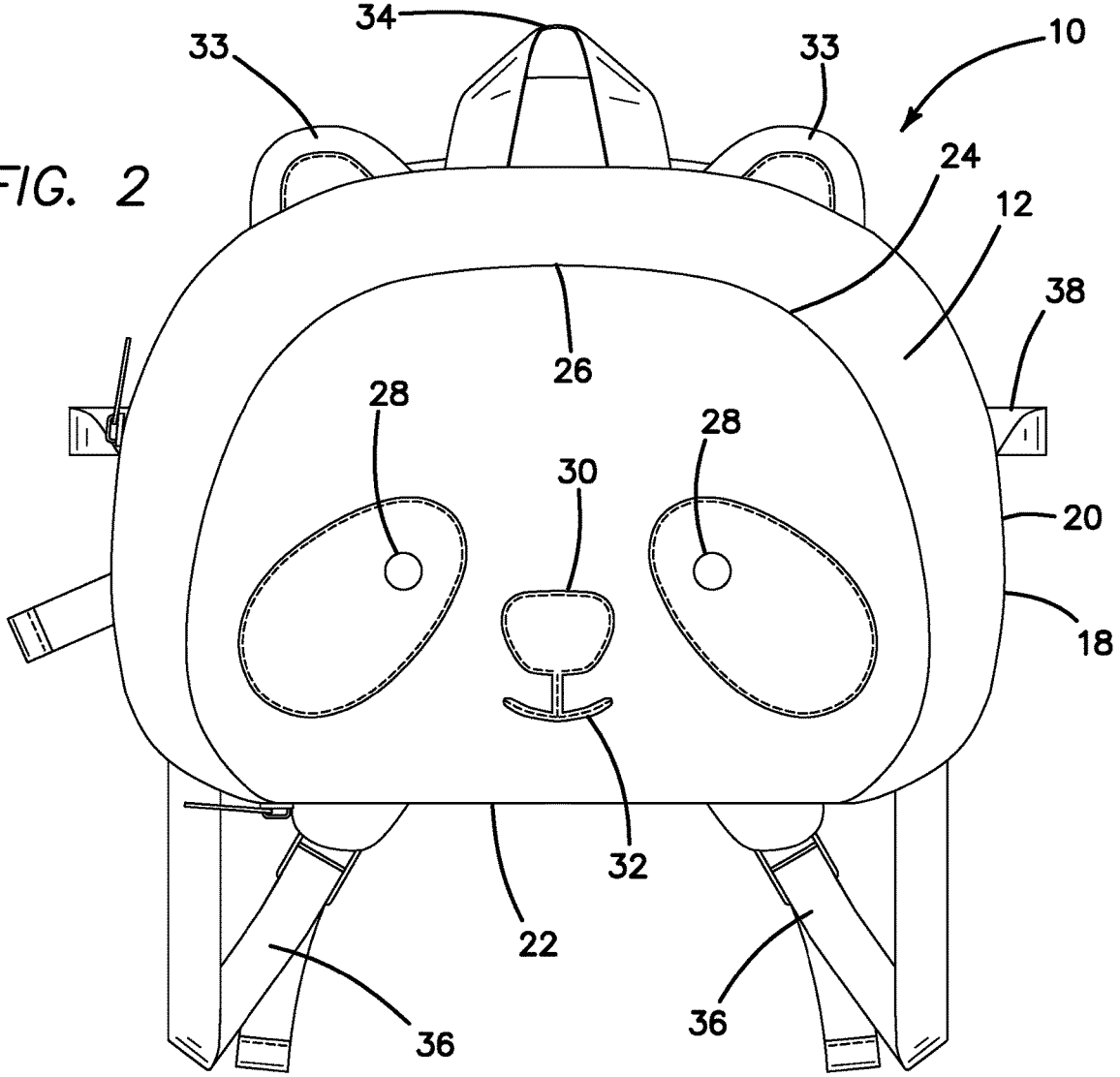
FIG. 2 is a front plan view of a portable activity tray according to the present invention.
Figure 3:
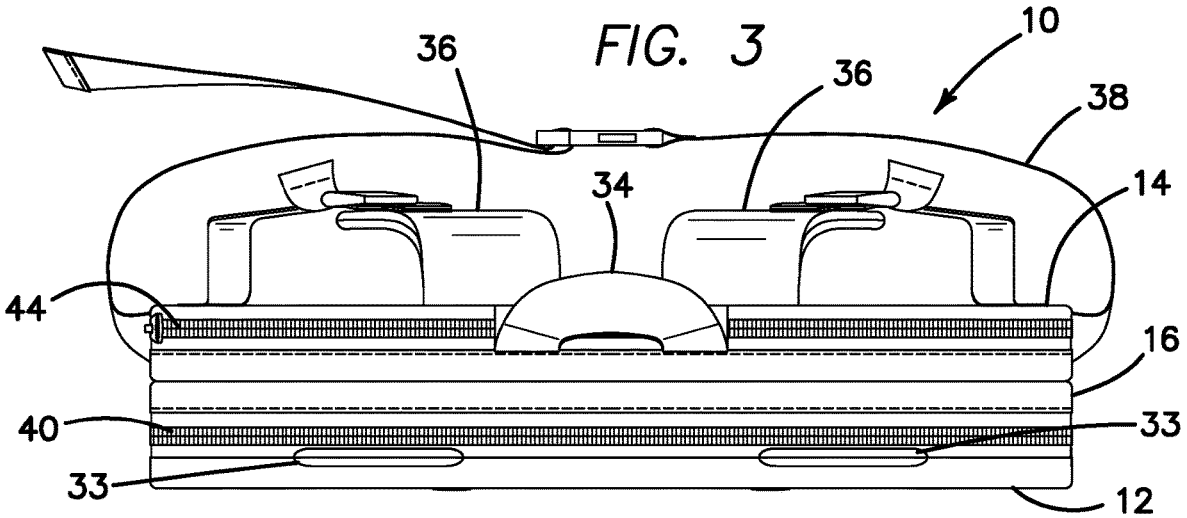
FIG. 3 is a top view of a portable activity tray according to the present invention.
Figure 6:
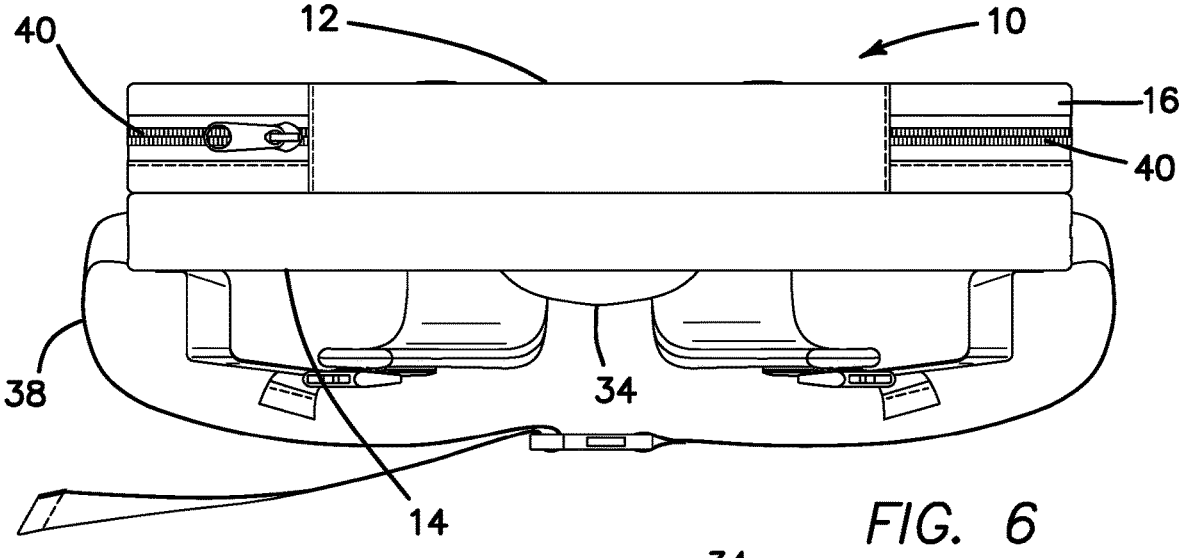
FIG. 6 is a bottom plan view of a portable activity tray according to the present invention.
Figure 7:
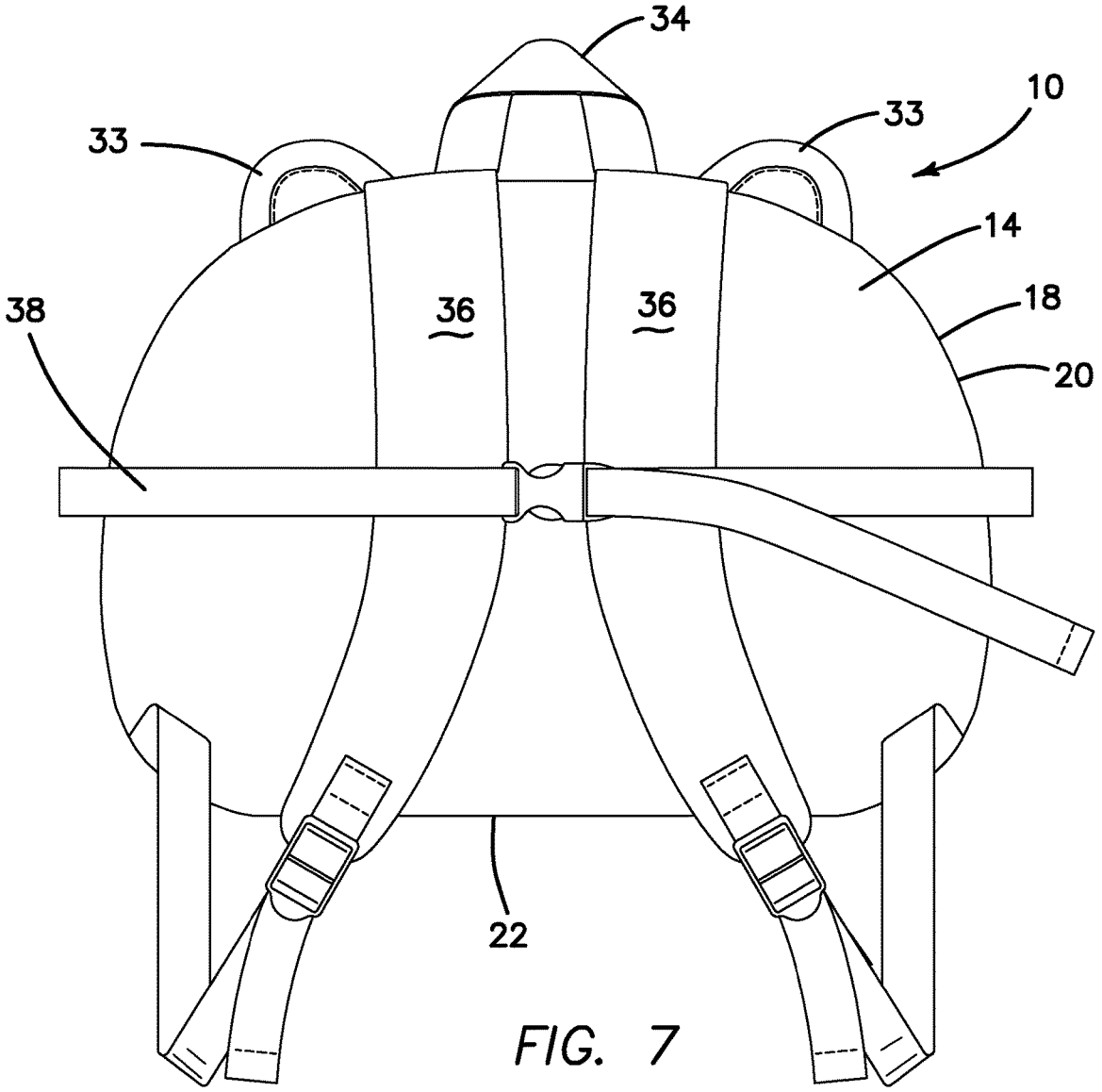
FIG. 7 is a rear plan view of a portable activity tray according to the present invention.
Figure 8:
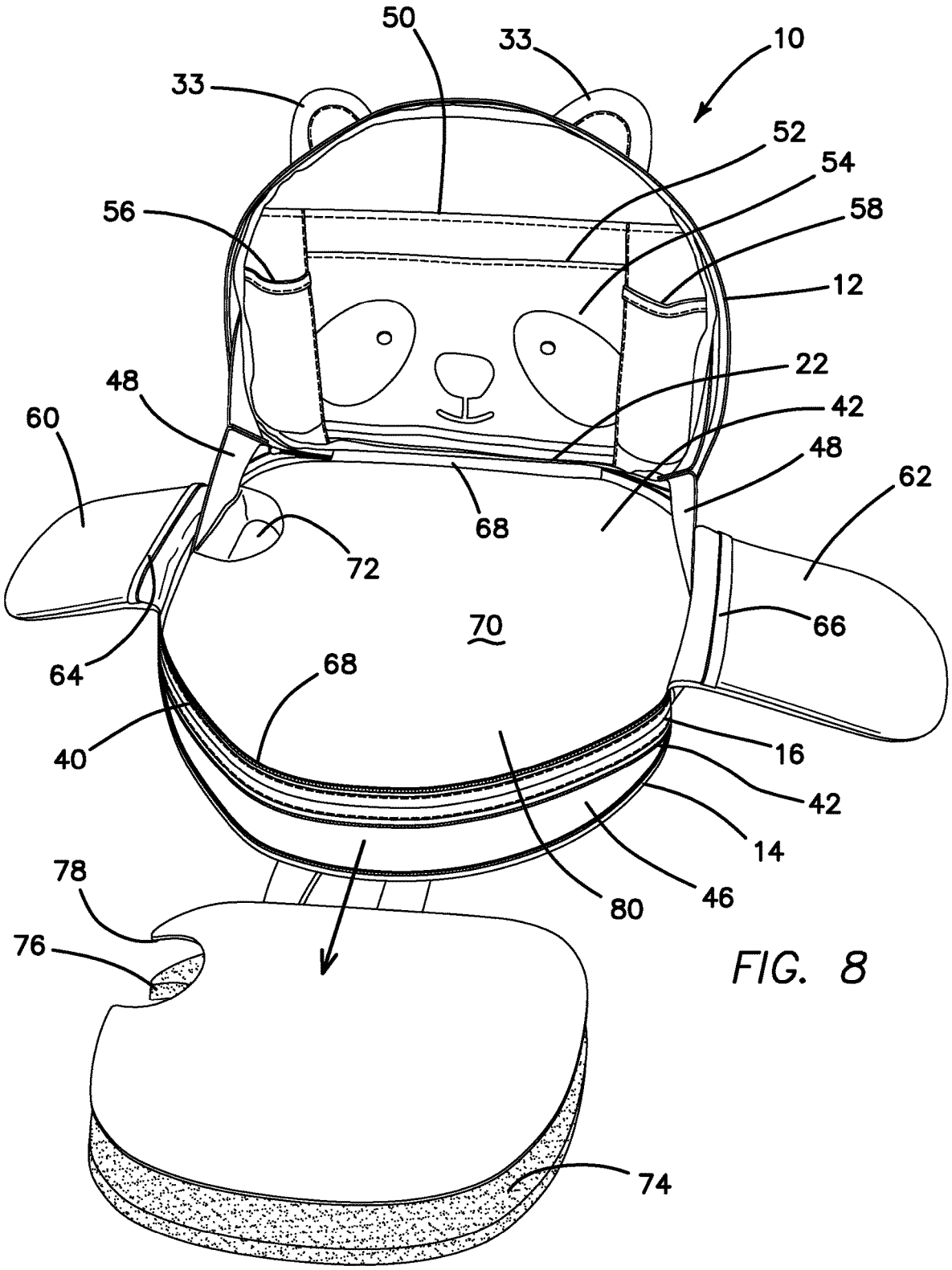
FIG. 8 is a top perspective view of a portable activity tray in an open orientation with interior pads and hard surface removed according to the present invention.
Figure 9:
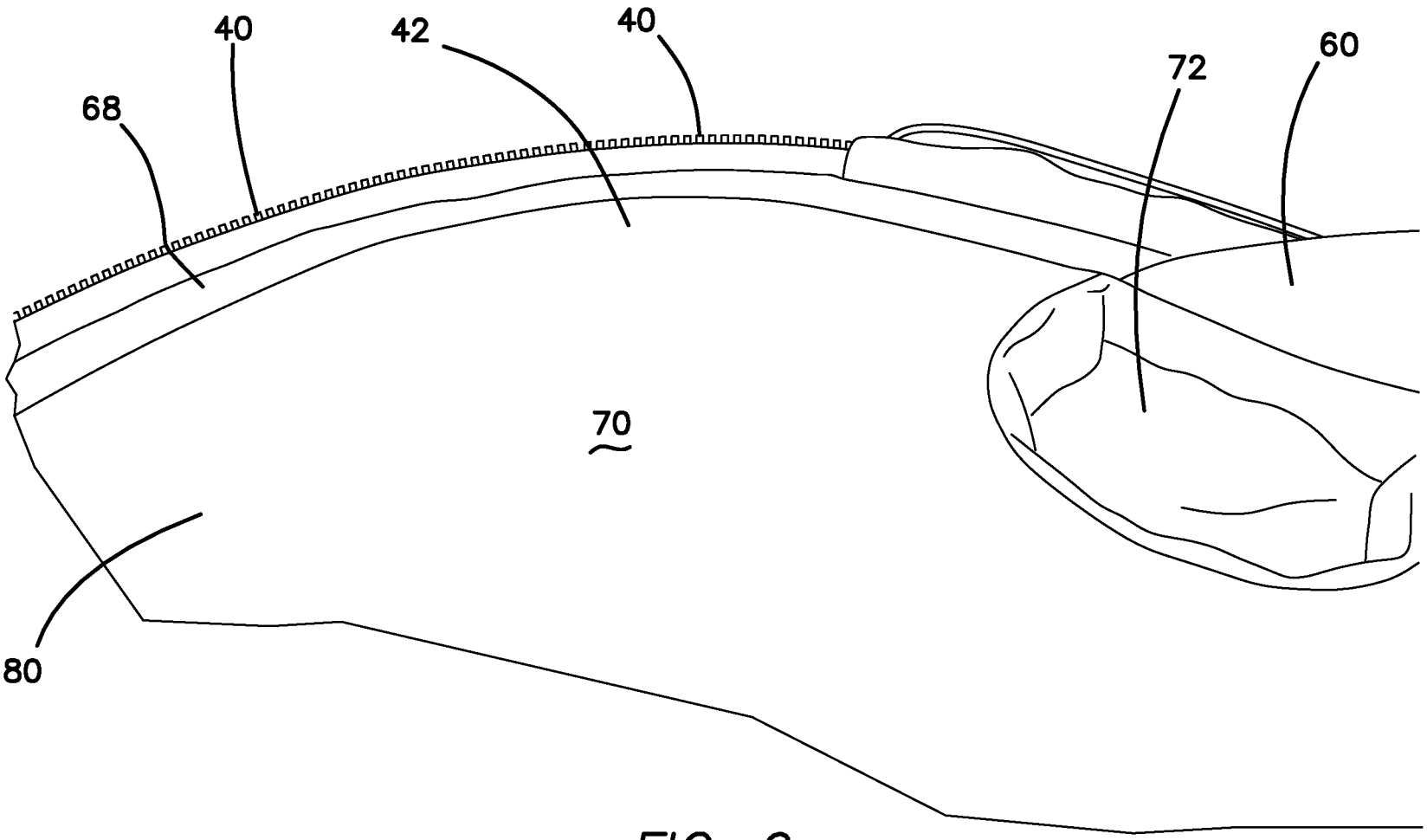
FIG. 9 is a top perspective detail view of a flat activity surface of a portable activity tray according to the present invention.

Turning now to FIGS. 1-7, there is shown a portable activity tray 10 according to the present invention in a closed position. The closed position is suitable for carrying. An open position of the tray 10 is depicted in FIGS. 8-9. The activity tray 10 includes a front panel 12 and a back panel 14 interconnected by a side panel 16. The front panel 12 and the back panel 14 have the same size and shape and are interconnected by the side panel 16 such that the side panel 16 is perpendicular to both the front panel 12 and the back panel 14. The side panel 16 extends all the way around the tray 10 providing the tray 10 with a substantially uniform thickness of approximately 3 inches. A tray perimeter 18 is defined by all of the outer edges of the front panel 12, back panel 14 and side panel 16. The tray perimeter 18 includes a single rounded perimeter portion 20 around the top of the tray 10 connected to a single straight, horizontal perimeter portion 22 along the bottom of the tray 10. The straight perimeter portion 22 formed by front, back and side panels 12, 14, 16 advantageously permit the tray 10 to be placed on a flat surface such as a table top such that the straight perimeter is against the flat surface for resting the tray 10 and for accessing or opening the tray 10. The front panel 12 includes an outer surface interconnected to an inner surface typically made of fabric material such as polyester or cotton. Batting or cardboard reinforcement may be included between the outer surface and inner surface. The back panel 14 also includes an outer surface interconnected to an inner surface typically made of fabric material such as polyester or cotton. Batting or cardboard reinforcement may be included between the outer surface and inner surface of the back panel 14 also.

The outer surface of front panel 12 includes a face 24 having a top that corresponds with the top of the tray 10 and a bottom of the face that is aligned with the bottom of the tray 10. The face 24 includes an outline 26 of the face 24 that follows the outline of the tray 10 having a curved portion and a flat portion. The face 24 includes two eyes 28, a nose 30 and a mouth 32. The facial features are sized and configured to correspond with the intended animal, animal-like, humanoid, cartoon or other creature the tray 10 is intended to simulate. For example, a panda is being simulated in the tray 10 shown in the figures. The panda is shown to have characteristic elongated-shaped outlines around the eyes which may be black in color against a white-colored face. The side panel 16 near the top of the tray 10 and close to the front panel 12 includes two ears 33 that protrude outwardly from the general tray perimeter 18 described above. The ears 33 are configured to correspond to the intended animal, animal-like, humanoid, cartoon or other creature the tray 10 is intended to simulate.

At the intersection of the rear panel 14 and the side panel 16 near the top of the tray 10, a loop 34 is provided for hanging the tray 10 on a hook or for carrying the tray 10 in hand. The back panel 14 includes a pair of adjustable backpack straps 36 sized and configured for carrying the tray 10 on child's back. Each backpack strap 36 has an end connected near the top of the tray 10 such that the face 24 is oriented right-side up and displayed outwardly and is visible to passersby as the child wears the tray 10 with the bottom perimeter portion 22 of the tray 10 facing down. The opposite end of each backpack strap 36 is connected near the straight bottom perimeter portion 22. The tray 10 further includes an adjustable chest strap 38 which may also be called a waist strap 38. The chest strap 38 has two ends with each end connected to the side panel 16 at an equal height approximately halfway up along the side panel 16. The chest strap 38 includes a buckle fastener that can be easily and quickly snapped together or unsnapped to remove and release the chest strap 38. When the tray 10 is in an opened position, the chest strap 38 is placed and buckled around the child's chest or waist to secure the activity tray 10 in a stable orientation while in use.

The side panel 16 includes a first zipper 40 configured for opening/closing an opening to a first compartment 42 of the tray 10. Both ends of the first zipper 40 are at the bottom perimeter portion 22 of the side panel 16 and extend around the curved perimeter portion 20 providing a large flap-like opening to the front panel 12. The first zipper 40 runs parallel to the front panel 12. The side panel 16 also includes a second zipper 44 configured for opening/closing an opening to a second compartment 46. Both ends of the second zipper 44 start and end at approximately midway up along the height of the tray 10 and extend around the top of the curved perimeter portion 20. The second zipper 44 runs parallel to the back panel 14. The waist strap 38 is attached to the side panel 16 at a location just beneath the ends of the second zipper 44. An inner panel 80 divides the first compartment 42 and the second compartment 46. The inner panel 80 is a shared wall having a first surface constituting the activity surface 70 facing the first compartment 42 and a second surface facing the second compartment 46. The first zipper 40 is located between the front panel 12 and the inner panel 80 and the second zipper 44 is located between the back panel 14 and the inner panel 80. The inner panel 80 is aligned and contiguous with the front panel 12 and back panel 14 along an axis perpendicular to the panels 12, 14, 80 when in a closed position.

The tray 10 may be placed on a flat surface such as a table top with the front panel 12 facing up and the back panel 14 facing the table top. When the first zipper 40 is unzipped, the front panel 12 is movable into an open position as depicted in FIG. 8. The front panel 12 hinges along at least a portion of the straight bottom perimeter portion 22. Two side support straps 48 are connected to the side panel 16 and to the front panel 12 and configured to keep the front panel 12 in a relatively upright, open orientation with respect to the table top and to prevent the front panel 12 from flopping over completely.

The inner surface of the front panel 12 includes a first pocket 50 having a horizontal opening extending from edge-to-edge of the front panel 12. The opening of the first pocket 50 faces upwardly toward the rounded top of the front panel 12. The opening of the first pocket 50 is located a little more than halfway up the side panel 12. The first pocket 50 is deep having a straight bottom along near the bottom perimeter 20. A second pocket 52 is provided. The second pocket 52 has a horizontal opening approximately one inch below the first pocket 50 opening and is parallel to it. The opening of the second pocket 52 is centered beneath the first pocket 50, faces upwardly toward the rounded top of the front panel 12 and is shorter in width than the first pocket 50. The opening of the second pocket 52 is also horizontal and faces the same direction as the first pocket 50. The depth of the second pocket 52 is straight and extends all the way to and along near the bottom perimeter portion 22 and is less deep than the first pocket 50. The second pocket 52 is made of clear plastic material providing a window to the contents located inside the second pocket 52. The inner surface of the first pocket 50 includes a face 54 that is identical in size and shape to the face on the outer surface of the front panel 12. This face 54 on the first pocket 50 is visible through the second pocket 52 if there are no objects placed inside the second pocket 52 that would obscure the face 54. When the front panel 12 is in the open position, the face 54 advantageously is oriented directly opposite from a child in position using the tray 10 advantageously giving the child a feeling of companionship, comfort and entertainment. A third pocket 56 is provided on one side of the second pocket 52 and a fourth pocket 58 is provided on the opposite side of second pocket 52. The third and fourth pockets 56, 58 are side pockets made of netting or mesh material that is partially see-through perfect for holding pencils and crayons. The openings of the fourth and fifth pockets 56, 58 also face the rounded top of the front panel 12 and are located slightly beneath the opening of the second pocket 52. These openings have a band of elastic material that help contain items within. The third and fourth pockets 56, 68 have an equal depth that extends all the way along near the bottom perimeter 22. All of the pockets 50, 52, 56, 58 that are located on the inner surface of the front panel 12 have openings that face in the same direction upwardly toward the ears 33 and top of the tray 10 when closed and the top of the front panel 12 when in the open position. This orientation of the openings advantageously prevents items from falling out of these pockets while the front panel 12 is in the open position and while the front panel 12 is in a closed position and being carried.

A first side flap 60 and a second side flap 62 is provided. Each side flap 60, 62 is hingedly connected to the side panel 14 opposite from each other. Each side flap 60, 62 can fold outwardly and rest in an outwardly splayed manner when the first zipper 40 is unzippered and the front panel 12 is opened. The side flaps 60, 62 are made of flexible fabric material and have an outer surface and an inner surface. The first side flap 60 has a first flap pocket 64 on the inner surface of the flap 60 having an opening running substantially parallel to the rounded perimeter 20 of the side panel 16. The first flap pocket 64 is comprised of a mesh material that is partially see-through and has a band of elastic to help contain items within it. The second side flap 62 has a second flap pocket 66 formed on its inner surface and has an opening running substantially parallel to the rounded perimeter 20 of the side panel 16 on the opposite side. The second flap pocket 66 is comprised of a mesh material that is partially see-through and has a band of elastic to help contain items within it. When the flaps 60, 62 are in an open position, the flap pocket openings face the middle of the first compartment 42. When in an open position, the flaps rest slightly over the side panel 14 with the flaps resting at an angle such that flap pocket opening are raised higher than the bottom of the flap pocket helping to keep items inside the flap pocket. When the flaps 60, 62 are in a closed position and resting on the activity surface 70, the flap pocket openings face outwardly toward the side panel 16. Because the first compartment 42 has a ledge 68 of approximately half-inch in height along the perimeter of the first compartment 42, items located in the flap pockets 60, 62 are advantageously and effectively contained and prevented from falling out of the flap pockets 60, 62 by the ledge 68 serving as a stop wall for items in the flap pockets. The top edge of this ledge 68 includes the mating portion of the first zipper 40 and the opposite mating portion of the first zipper 40 is located along the perimeter of the side panel 16 at the front panel 12. The first zipper 40 advantageously provides stiffness to create an upstanding ledge 68 surrounding the periphery of the activity surface 70 with the hinge at the bottom perimeter portion 22 completing the peripheral ledge 68. The ledge 68 encompasses the activity surface 70 of the tray 10. The activity surface 70 is flat and smooth and covered with fabric material of the inner panel 80. This fabric material is made of polyester that is easily cleaned and wiped down. Because the ledge 68 encompasses the activity surface 70, items are contained within the perimeter of the tray 10 which is also the perimeter of the activity surface 70. Items such as writing instruments are prevented from rolling off the activity surface 70 and falling out of the tray 10 and getting lost. The ledge 68 also forms the first compartment 42 giving the first compartment 42 height and making it capable of storing items in the first compartment 42 when the first zipper 40 is closed. The ledge 68 is clearly shown in FIG. 9. The activity surface 70 is also provided with an indentation 72 that is sized and configured for holding a sippy cup. The indentation 72 is sewn into the fabric of the inner panel 80 in a shape and size that conforms to a children's drinking cup. The cup holder 72 prevents a beverage container from tipping over and spilling.

With continued reference to FIG. 8, the second compartment 46 includes a removable foam pad 74 that is sized and configured to conformingly fit and fill the inside of the second compartment 46. The foam pad 74 is thick and is approximately equal or slightly thinner than the thickness of the second compartment 46. The foam pad 74 is approximately one inch thick. The foam pad 74 includes a cutout 76 that forms the receiving portion of the cup holder indentation 72. The cutout 76 conforms in size and shape to the indentation 72 in the inner panel 80 which is located inside the cutout 76. The foam pad 74 advantageously provides thickness to the tray 10 lifting the activity surface 70 higher from the knees of the child making it more comfortable and ergonomic for the child to use and softer to support on the child's lap. A removable hard layer 77 of plastic material is also provided inside the second compartment 46. The hard layer 77 also includes a cutout 78 aligned with the cutout 76 in the foam layer 74 and the indentation 72. The hard layer 77 of plastic material is located inside the second compartment 46 above the foam pad 74 and facing the inner panel 80 and provides a smooth and hard surface for various activities such as writing and drawing that are undertaken on the activity surface 70. The foam pad 74 and the hard layer 77 are removable to provide more storage space for carrying items inside the second compartment 46. Even with the foam pad 74 and hard layer 77 located inside the second compartment 46, additional items such as papers and small books may be stowed inside the second compartment 46. An inner panel 80 of fabric material divides the first compartment 42 from the second compartment 46. This inner panel 80 constitutes the activity surface 70 of the first compartment 42 and includes the indentation 72 formed of fabric material sewn to conform in size and shape of a cylindrical like cup making the indentation 72 flexible which can be pushed into the cutouts 76, 78 and made to conform therein. In one variation, the inner panel 80 may incorporate the hard layer 77 sandwiched between two layers of fabric material constituting the inner panel 80.

It is understood that various modifications may be made to the embodiments of the portable activity tray disclosed herein. Therefore, the above description should not be construed as limiting, but merely as exemplifications of preferred embodiments. Those skilled in the art will envision other modifications within the scope and spirit of the present disclosure.

I claim:

1. A portable activity tray for children comprising:

a flat front panel having an inner surface and an outer surface;

a flat back panel having an inner surface and an outer surface;

a side panel perpendicular to and interconnecting the front panel and the back panel;

an inner panel connected to the side panel along its perimeter; the inner panel being aligned with the front panel and the back panel;

a first compartment defined between the front panel and the inner panel; the first compartment having a first opening that is closable with a first zipper; the first compartment having a flat activity surface and a continuous ledge around an entire perimeter of the activity surface;

a second compartment defined between the back panel and the inner panel and having a second opening that is closable with a second zipper; the inner panel dividing and forming a shared wall between the first compartment and the second compartment;

a removable foam pad located inside the second compartment; and a removable hard layer located inside the second compartment and adjacent to the inner panel;

wherein the inner panel includes a cup holder; the foam pad and hard layer having cutouts sized and configured to conform and align with the cup holder.

2. The activity tray of claim 1 wherein the inner surface of the front panel includes at least a first horizontal pocket having a first pocket opening all facing a top of the front panel.

3. The activity tray of claim 1 having an open position in which the front panel is hinged open to expose the activity surface.

4. The activity tray of claim 3 further including at least one side-support strap between the front panel and inner panel configured to keep the front panel in an open position.

5. The activity tray of claim 1 wherein the activity surface is defined by the inner panel.

6. The activity tray of claim 1 further including:

a first side flap located inside the first compartment; the first side flap being foldably connected to an inner surface of the side panel; the first side flap having an inner surface and an outer surface; the first side flap having first flap pocket located on the inner surface of the first side flap and a first flap pocket opening that faces the side panel when in a closed position; and a second side flap located inside the first compartment and further located oppositely from the first side flap; the second side flap being foldably connected to an inner surface of the side panel; the second side flap having an inner surface and an outer surface; the second side flap having a second flap pocket located on the inner surface of the second side flap and a second flap pocket opening that faces the side panel when in a closed position.

7. The activity tray of claim 1 further including a removable foam pad located inside the second compartment.

8. The activity tray of claim 1 further including a hard layer adjacent to the inner panel.

9. The activity tray of claim 8 wherein the hard layer is removable and located inside the second compartment.

10. The activity tray of claim 1 further including backpack straps connected to the back panel.

11. The activity tray of claim 1 wherein the front panel, back panel, inner panel and side panel define a single rounded perimeter portion around a top connected to a single straight perimeter portion along a bottom.

12. The activity tray of claim 11 wherein the front panel is hingedly connected along the straight perimeter portion.

13. The activity tray of claim 11 further including a pair of ears that protrude outwardly from the rounded perimeter portion near the top.

14. The activity tray of claim 11 wherein the first zipper extends around the rounded perimeter portion with ends of the first zipper located at the opposite ends of the straight perimeter portion.

15. The activity tray of claim 11 wherein the second zipper extends around part of the rounded perimeter portion.

16. The activity tray of claim 1 further including a face on the outer surface of the front panel.

17. The activity tray of claim 16 further including a face on the inner surface of the front panel.

18. The activity tray of claim 1 further including a chest strap connected to opposite sides of the side panel.

* * * * *